US007638724B2

(12) United States Patent
Altmann et al.

(10) Patent No.: US 7,638,724 B2
(45) Date of Patent: Dec. 29, 2009

(54) SWITCH MODULE

(75) Inventors: Markus Altmann, Moos (DE); Juergen Schmider, Constance (DE)

(73) Assignee: TRW Automotive Electronics & Components GmbH & Co. KG, Radolfzell (DE)

( * ) Notice: Subject to any disclaimer, the term of this patent is extended or adjusted under 35 U.S.C. 154(b) by 142 days.

(21) Appl. No.: 11/725,000

(22) Filed: Mar. 16, 2007

(65) Prior Publication Data

US 2007/0221487 A1 Sep. 27, 2007

(30) Foreign Application Priority Data

Mar. 22, 2006 (DE) ..... 20 2006 004 575 U

(51) Int. Cl.
*H01H 1/10* (2006.01)

(52) U.S. Cl. ..... 200/517; 200/6 A

(58) Field of Classification Search ..... 200/293, 200/329, 339, 553, 557, 559, 5 R, 6 A, 517
See application file for complete search history.

(56) References Cited

U.S. PATENT DOCUMENTS

| | | | | |
|---|---|---|---|---|
| 4,231,098 | A | 10/1980 | Tanimoto | |
| 4,716,262 | A * | 12/1987 | Morse | 200/5 A |
| 4,839,474 | A | 6/1989 | Hayespankhurst et al. | |
| 5,089,671 | A * | 2/1992 | Ranetkins | 200/5 A |
| 6,417,469 | B1 | 7/2002 | Tamura | |
| 6,806,815 | B1 * | 10/2004 | Kaikuranta et al. | 341/22 |
| 6,974,919 | B2 * | 12/2005 | Mori et al. | 200/5 R |
| 6,984,799 | B2 * | 1/2006 | Kawaguchi et al. | 200/512 |
| 7,019,225 | B2 * | 3/2006 | Matsumoto et al. | 200/5 R |
| 7,026,565 | B1 * | 4/2006 | Lee | 200/339 |
| 7,030,324 | B2 * | 4/2006 | Gotoh | 200/6 A |
| 7,034,232 | B2 * | 4/2006 | Ide et al. | 200/5 A |
| 7,094,985 | B2 * | 8/2006 | Kobayashi et al. | 200/516 |
| 7,138,978 | B2 * | 11/2006 | Ohgitani | 345/156 |
| 7,151,236 | B2 * | 12/2006 | Ducruet et al. | 200/406 |
| 7,271,360 | B2 * | 9/2007 | Kobayashi | 200/314 |
| 7,282,657 | B2 * | 10/2007 | Wimmer et al. | 200/302.2 |
| 7,378,606 | B2 * | 5/2008 | Lee et al. | 200/314 |
| 7,385,150 | B1 * | 6/2008 | Siddiqui et al. | 200/5 A |
| 7,394,034 | B2 * | 7/2008 | Ostendorf et al. | 200/314 |
| 7,394,038 | B2 * | 7/2008 | Chang | 200/341 |
| 7,417,199 | B2 * | 8/2008 | Nielsen | 200/5 E |

FOREIGN PATENT DOCUMENTS

| | | |
|---|---|---|
| DE | 2540011 | 3/1976 |
| DE | 19812249 | 9/1999 |

(Continued)

*Primary Examiner*—Michael A Friedhofer
*Assistant Examiner*—Lisa N Klaus
(74) *Attorney, Agent, or Firm*—Tarolli, Sundheim, Covell & Tummino LLP

(57) ABSTRACT

A switch module includes a switch housing on which at least one operating button or operating rocker is movably guided. The switch module further includes a printed circuit board which is arranged in the switch housing and on which conductor paths with switching contacts are formed, a switching mat which rests on the conductor paths, and an actuating element which transfers the stroke of the operating button or operating rocker to the switching mat. The switching mat engages around the outer edge of the printed circuit board with a form fit.

16 Claims, 2 Drawing Sheets

FOREIGN PATENT DOCUMENTS

| | | |
|---|---|---|
| DE | 19812251 | 9/1999 |
| DE | 10027484 | 12/2001 |
| DE | 10248830 | 10/2003 |
| DE | 20317635 | 4/2004 |
| DE | 102004026874 | 12/2005 |
| EP | 0110094 | 10/1983 |
| EP | 1091374 | 4/2001 |

* cited by examiner

SWITCH MODULE

TECHNICAL FIELD

The invention relates to a switch module, in particular to a switch module comprising a switch housing on which at least one operating button or operating rocker is movably guided, the switch module further comprising a printed circuit board which is arranged in the switch housing and on which conductor paths with switching contacts are formed, a switching mat which rests on the conductor paths, and an actuating element which transfers the stroke of the button or rocker to the switching mat.

BACKGROUND OF THE INVENTION

Printed circuit boards can be produced with a high degree accuracy in their length and width. Their thickness, however, is subject to considerable tolerances of more than +/−0.1 mm. On the other hand, the printed circuit board requires a defined support on the switch housing on its side facing the switching mat, in order to guarantee a constant actuating stroke. The printed circuit board is supported by a holding frame or the like on its surface which lies opposite the switching mat. The holding frame is connected with the switch housing by a screw fastening in order that the printed circuit board is held free of play despite its thickness being subject to tolerances. In this conventional construction of the switch module, it is not possible to use a simple detent connection.

SUMMARY OF THE INVENTION

The switch module according to the invention comprises a switch housing, at least one operating element (preferably an operating button or an operating rocker), a printed circuit board, a switching mat, and an actuating element. The operating element is movably guided on the switch housing. The printed circuit board is arranged in the switch housing and has conductor paths with switching contacts. The switching mat rests on the conductor paths. The actuating element transfers the stroke of the operating element to the switching mat. The switching mat engages around an outer edge of the printed circuit board with a form fit. The switching mat therefore has two auxiliary functions. On the one hand, through its elastic quality, it makes a tolerance compensation possible. On the other hand, the outer periphery of the switching mat acts as a seal. The printed circuit board can now be clamped between a support on the switch housing and the holding frame, and the holding frame can be connected with the switch housing by a simple detent connection. The switching mat has a greatly reduced thickness of only a few tenths of a mm in its area between the support on the switch housing and the printed circuit board, so that the printed circuit board sits in a defined position relative to the switch housing.

DETAILED DESCRIPTION OF THE PREFERRED EMBODIMENTS

Figure 1A:
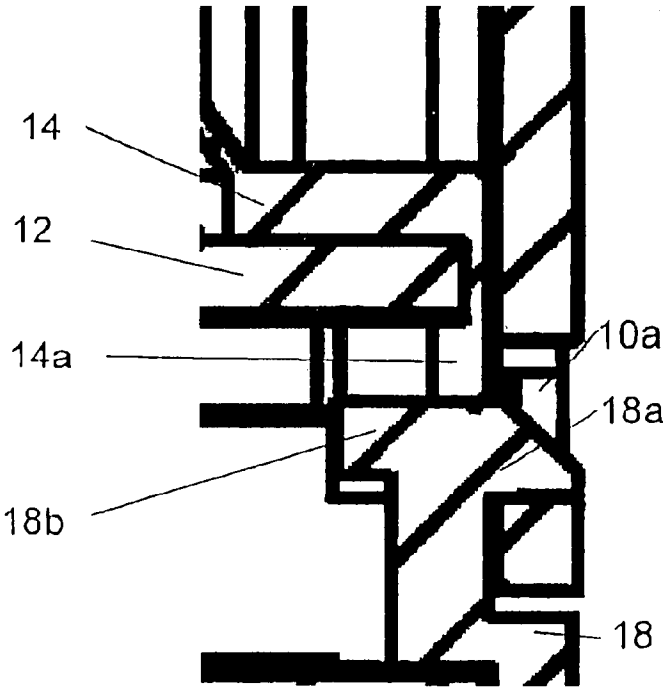
FIG. 1*a* shows an enlarged portion "A" in FIG. 1.
Figure 1:
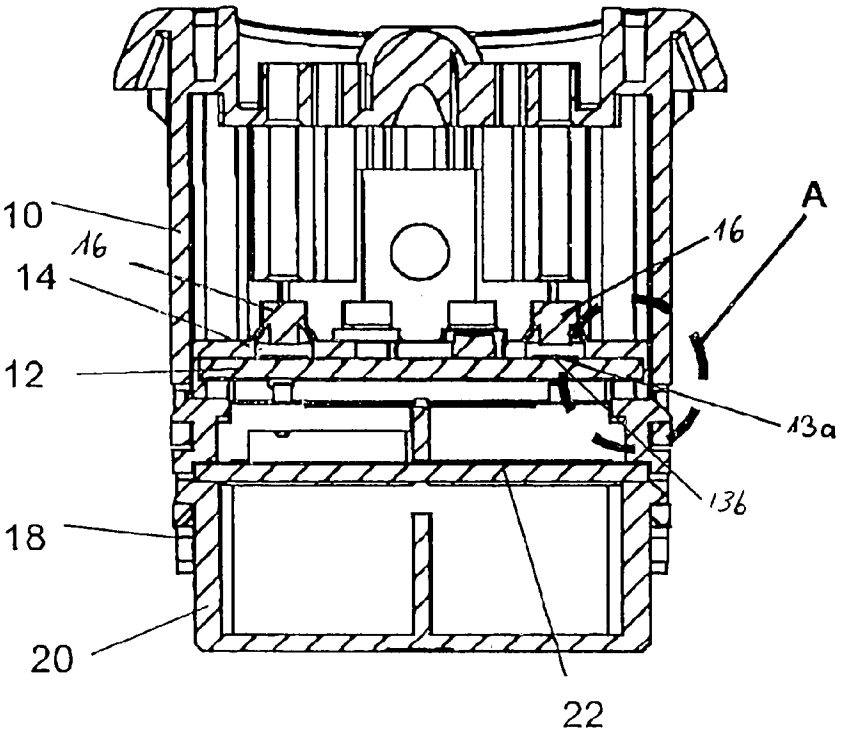
FIG. 1 shows an axial section of a switch module.

The switch module illustrated in the drawings is a multiple switch for installation in a shield of a vehicle. The switch module has a generally parallelepiped-shaped switch housing 10 made of plastic. Guides for buttons (not illustrated) are formed on the switch housing 10. A printed circuit board 12, which is provided with conductor paths 13*a* and switching contacts 13*b* on its surface facing the buttons, is inserted in the switch housing 10. A switching mat 14 rests on the conductor paths 13*a* and switching contacts 13*b*. The switching mat 14 is made of an elastomer material. It is provided with formed-on switching domes 16 which have a contact pill on their surface lying over an associated contact pair. The switching domes 16 are connected to associated buttons or operating rockers by means of operating elements (not illustrated) such as plungers or suchlike. The printed circuit board 12 is clamped with the switching mat 14 between a support on the switch housing 10 and a holding frame 18, which is connected with the switch housing 10 by a detent connection.

Figure 2A:
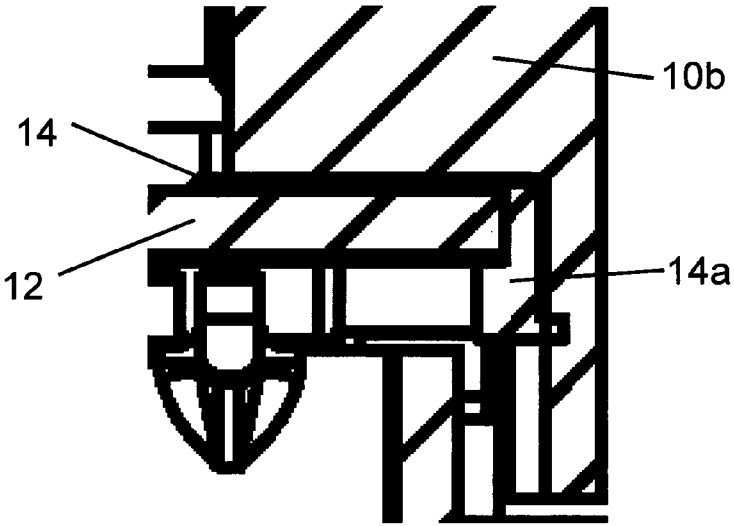
FIG. 2*a* shows an enlarged portion "A" in FIG. 2.
Figure 2:
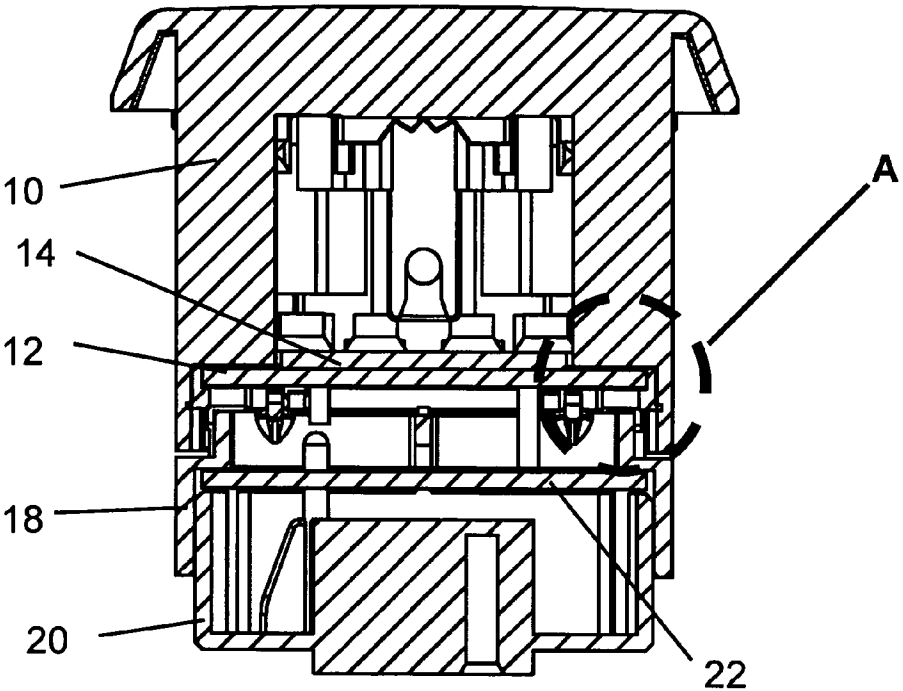
FIG. 2 shows an axial section of the switch module in a plane rotated through 90 degrees with respect to FIG. 1.

As can be seen better from FIG. 1*a*, the switching mat 14 embraces the outer edge of the printed circuit board 12 with a form fit on its outer periphery. The outer periphery of the switching mat 14 lies flush against the inner surface of the switch housing 10. The holding frame 18 has a detent nose 18*a* which engages into a detent window 10*a* in the wall of the switch housing 10. In addition, a support rib 18*b* is formed on the detent nose 18*a*, on which support rib 18*b* the edge 14*a* of the switching mat 14 rests which embraces the printed circuit board 12. It can be seen from FIG. 2*a* that the support for the switching mat and the printed circuit board on the switch housing 10 is formed by a support rib 10*b* which is formed on the switch housing 10. The thickness of the switching mat 14 is greatly reduced in its region between the printed circuit board 12 and the support rib 10*b*. It amounts to only a few tenths of a mm there. A well defined support position of the printed circuit board 12 relative to the switch housing 10 is thereby guaranteed.

The holding frame 18 surrounds a base part 20 with an integrated plug chamber which is connected by a detent connection with the holding frame 18. A further printed circuit board 22 is clamped between the holding frame 18 and the base part 20. The printed circuit board 22 is provided with contact elements for a connection plug (not illustrated).

Although the printed circuit board 12 has a well defined bearing position in relation to the switch housing 10, its thickness may be subject to tolerance, because it is clamped elastically between the switching mat 14 and the support ribs 18*b* of the holding frame 18, the marginal region 14*a* of the switching mat 14 between the printed circuit board 12 and support ribs 18*b* being elastically compressed. In this way, not only does a tolerance compensation take place with respect to the thickness of the printed circuit board 12, but also a sealing of the printed circuit board 12 against the switch housing 10. Owing to the tolerance compensation, a detent connection of the holding frame 18 with the switch housing 10 is easily possible.

In a simplified embodiment of the switch module, the second printed circuit board 22 is dispensed with, and instead of the holding frame 18 the base part 20 is directly connected with the switch housing 10. The detent noses on the base part 20 are formed so as to match the detent windows on the switch housing 10, and also the detent windows on the holding frame 18.

The invention claimed is:

1. A switch module, comprising a switch housing, at least one operating element, a printed circuit board, a switching mat, and an actuating element, the operating element being movably guided on the switch housing, the printed circuit board being arranged in the switch housing and having conductor paths with switching contacts, the switching mat being made of an elastomer material and comprising a formed-on switching dome, the switching mat resting on the conductor paths, the actuating element transferring the stroke of the operating element to the switching mat, the switching mat engaging around an outer edge of the printed circuit board with a form fit, wherein the switching mat and the printed circuit board are clamped between a support on the switch housing and one of a holding frame and a base part connected with the switch housing.

2. The switch module according to claim 1, wherein the support on the switch housing is formed by molded-on support ribs, the switching mat having a reduced thickness between the support ribs and the printed circuit board.

3. The switch module according to claim 1, wherein the holding frame or the base part, respectively, is fastened to the switch housing by a detent connection.

4. The switch module according to claim 1, wherein an outer periphery of the switching mat lies flush against an inner surface of the switch housing.

5. The switch module according to claim 1, wherein the holding frame surrounds the base part having an integrated plug chamber, the base part being connected to the holding frame by a detent connection, a further printed circuit board having contact elements being clamped between the holding frame and the base part.

6. The switch module according to claim 1, wherein the base part has detent elements which are constructed so as to match both corresponding detent elements of the switch housing and also corresponding detent elements of the holding frame.

7. The switch module according to claim 1, wherein the operating element comprises one of an operating button and an operating rocker.

8. A switch module, comprising a switch housing, at least one operating element, a printed circuit board, a switching mat, and an actuating element, the operating element being movably guided on the switch housing, the printed circuit board being arranged in the switch housing and having conductor paths with switching contacts, the switching mat being made of an elastomer material and comprising a formed-on switching dome, the switching mat resting on the conductor paths, the actuating element transferring the stroke of the operating element to the switching mat, the switching mat engaging around an outer edge of the printed circuit board with a form fit, wherein one of a holding frame and a base part has support ribs in opposite position to the outer edge of the switching mat.

9. A switch module, comprising a switch housing, at least one operating element, a printed circuit board, a switching mat, and an actuating element, the operating element being movably guided on the switch housing, the printed circuit board being arranged in the switch housing and having conductor paths with switching contacts, the switching mat resting on the conductor paths, the actuating element transferring the stroke of the operating element to the switching mat, the switching mat engaging around an outer edge of the printed circuit board with a form fit, wherein the switching mat and the printed circuit board are clamped between a support on the switch housing and one of a holding frame and a base part connected with the switch housing.

10. The switch module according to claim 9, wherein the support on the switch housing is formed by molded-on support ribs, the switching mat having a reduced thickness between the support ribs and the printed circuit board.

11. The switch module according to claim 9, wherein the holding frame or the base part, respectively, is fastened to the switch housing by a detent connection.

12. The switch module according to claim 9, wherein the holding frame surrounds the base part having an integrated plug chamber, the base part being connected to the holding frame by a detent connection, a further printed circuit board having contact elements being clamped between the holding frame and the base part.

13. The switch module according to claim 9, wherein the base part has detent elements which are constructed so as to match both corresponding detent elements of the switch housing and also corresponding detent elements of the holding frame.

14. The switch module according to claim 9, wherein an outer periphery of the switching mat lies flush against an inner surface of the switch housing.

15. The switch module according to claim 9, wherein the operating element comprises one of an operating button and an operating rocker.

16. A switch module, comprising a switch housing, at least one operating element, a printed circuit board, a switching mat, and an actuating element, the operating element being movably guided on the switch housing, the printed circuit board being arranged in the switch housing and having conductor paths with switching contacts, the switching mat resting on the conductor paths, the actuating element transferring the stroke of the operating element to the switching mat, the switching mat engaging around an outer edge of the printed circuit board with a form fit, one of a holding frame and a base part having support ribs in opposite position to the outer edge of the switching mat.

* * * * *